US008308542B2

(12) United States Patent
Daines

(10) Patent No.: US 8,308,542 B2
(45) Date of Patent: Nov. 13, 2012

(54) BACCARAT CARD GAME WITH SIDE BETS

(76) Inventor: Franklin Daines, Red Deer (CA)

( * ) Notice: Subject to any disclaimer, the term of this patent is extended or adjusted under 35 U.S.C. 154(b) by 0 days.

(21) Appl. No.: 12/954,606

(22) Filed: Nov. 24, 2010

(65) Prior Publication Data

US 2012/0119441 A1 May 17, 2012

Related U.S. Application Data

(60) Provisional application No. 61/412,782, filed on Nov. 11, 2010.

(51) Int. Cl.
*A63F 1/00* (2006.01)
*A63F 13/00* (2006.01)

(52) U.S. Cl. ..... 463/12; 273/292; 273/274

(58) Field of Classification Search ..... 273/292, 273/274, 309; 463/13, 12
See application file for complete search history.

(56) References Cited

U.S. PATENT DOCUMENTS

| | | | | |
|---|---|---|---|---|
| 6,279,910 | B1 * | 8/2001 | de Keller | 273/292 |
| 6,644,666 | B1 * | 11/2003 | Tamura et al. | 273/292 |
| 7,651,096 | B2 * | 1/2010 | Friedman | 273/292 |
| 2008/0224402 | A1 * | 9/2008 | Snow et al. | 273/292 |

* cited by examiner

*Primary Examiner* — Benjamin Layno
(74) *Attorney, Agent, or Firm* — Muskin & Cusick LLC

(57) ABSTRACT

A method to implement two side bets for the casino card game of Baccarat. The player can choose to bet on a player side bet, a banker side bet, or play both side bets. The player side bet wins if, after the game is resolved, the player point total is one less than the banker point total, and loses in all other situations. The banker side bet wins if, after the game is resolved, the banker point total is one less than the player point total, and loses in all other situations. Subsets of these winning sets can be used as well for the winning combinations.

12 Claims, 4 Drawing Sheets

BACCARAT CARD GAME WITH SIDE BETS

CROSS REFERENCE TO RELATED APPLICATIONS

This application claims benefit to provisional application 61/412,782, filed on Nov. 11, 2010, entitled, "Baccarat Game with Side Bets" which is incorporated by reference herein in its entirety for all purposes.

BACKGROUND OF THE INVENTION

1. Field of the Invention

The present general inventive concept is directed to a method, apparatus, and computer readable storage medium directed to a casino wagering game on baccarat.

2. Description of the Related Art

The game of baccarat is well known in the art.

What is needed is a side bet for the game of baccarat which players will find interesting to play and casinos will find profitable.

SUMMARY OF THE INVENTION

It is an aspect of the present invention to provide an exciting casino wagering game.

The above aspects can be obtained by a method that includes (a) providing physical cards and a physical gaming table; (b) providing betting areas for a standard player bet, a standard banker bet, a player side wager, and a dealer side wager; (c) providing a predetermined rule for resolving the player side wager which provides that the player side wager wins if a banker point total is one higher than a player point total for at least some player point totals; (d) providing a predetermined rule for resolving a banker side wager which provides that the banker side wager wins if the player point total is one higher than the banker point total for at least some banker point totals; (e) offering a player to an option to place any combination of a standard player bet, a standard banker bet, the player side wager, and the dealer side wager; (f) dealing a player's hand and a banker's hand; (g) resolving the player's hand and the banker's hand according to predetermined baccarat rules; (h) resolving the player side wager, if placed, according to the predetermined rule for resolving the player side wager; and (i) resolving the dealer side wager, if placed, according to the predetermined rule for resolving the dealer side wager.

The above aspects can also be obtained by an apparatus that includes (a) an input device; (b) an output device; (c) a processing unit operationally connected to the input device and the output device, the processing unit executing instructions to perform: (d) providing a predetermined rule for resolving the player side wager which provides that the player side wager wins if a banker point total is one higher than a player point total for at least some player point totals; (e) providing a predetermined rule for resolving a banker side wager which provides that the banker side wager wins if the player point total is one higher than the banker point total for at least some banker point totals; (f) offering a player to an option to place any combination of a standard player bet, a standard banker bet, the player side wager, and the dealer side wager; (g) dealing a player's hand and a banker's hand; (h) resolving the player's hand and the banker's hand according to predetermined baccarat rules; (i) resolving the player side wager, if placed, according to the predetermined rule for resolving the player side wager; and (j) resolving the dealer side wager, if placed, according to the predetermined rule for resolving the dealer side wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
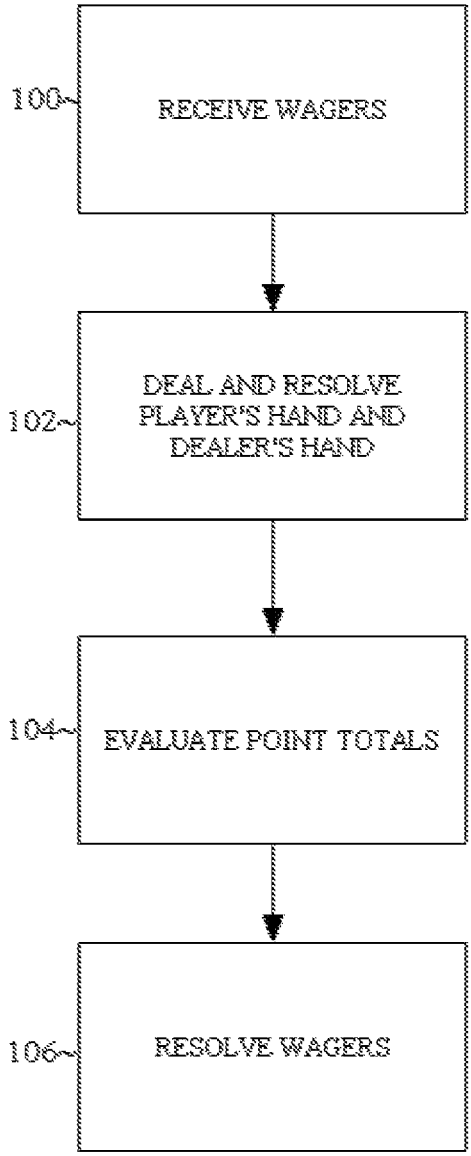
FIG. 1 is a flowchart illustrating a game of a baccarat, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a baccarat game. Baccarat is well known in the art, for example see U.S. Pat. No. 6,299,171 and U.S. pre-grant publication 2008/0032760, both documents of which are incorporated by reference herein in their entireties.

The rules of standard Baccarat are summarized in Table I below.

TABLE I

1) Usually eight decks of cards are used.

2) Cards are given point values as follows: ace = 1, 2-9 = pip value, 10 and face cards = 0.

3) At the start of a new shoe, the dealer will turn over one card. This will determine how many cards the dealer will burn, according to the baccarat value, except a 10 or face card will result in 10 cards burned.

4) The cut card will be placed 16 cards from the bottom of the shoe. When the cut card appears, the dealer will finish that hand, play one more hand, and then start a new shoe. If TABLE I-continued

| |
|---|
| the cut card comes out instead of the first card, the dealer will finish that hand, and then start a new shoe. |
| 5) Play begins by all players betting either on the "player", "banker", or a tie. At some tables you may also bet on a player pair and banker pair. |
| 6) After all bets are down, the dealer gives two cards each to the player and the banker. The score of the hand is the right digit of the total of the cards. For example, if the two cards were an 8 and 7, then the total would be 15 and the score would be a 5. The scores will always range from 0 to 9 and it is impossible to bust. |
| 7) A third card may or may not be dealt to either the player or the dealer depending on the following rules. A) If either the player or the banker has a total of an 8 or a 9 they both stand. This rule overrides all other rules. B) If the player's total is 5 or less, then the player hits, otherwise the player stands. C) If the player stands, then the banker hits on a total of 5 or less. If the player does hit then use Table II below to determine if the banker hits (H) or stands (S). |
| 8) The score of the player and dealer are compared; the winner is the one that is greater. Winning bets on the banker pay 19 to 20 (or even money less a 5% commission), winning bets on the player pay 1 to 1, winning bets on a tie usually pay 8 to 1. In the event of a tie, banker and player bets will push. |
| 9) On winning banker bets, the player will be paid even money. Meanwhile, the dealer will keep track of the 5% commission owed with small laminated markers. At the end of each shoe, or when a player wants to leave, the dealer will collect all commissions owed. |

Table II below shows the Baccarat drawing rules for the player's third card

TABLE II

| Banker's score | player's third card 0123456789 |
|---|---|
| 7 | SSSSSSSSSS |
| 6 | SSSSSSHHSS |
| 5 | SSSSHHHHSS |
| 4 | SSHHHHHHSS |
| 3 | HHHHHHHHSH |
| 2 | HHHHHHHHHH |
| 1 | HHHHHHHHHH |
| 0 | HHHHHHHHHH |

The rules of standard baccarat are also rephrased here. The player chooses a bet to place (player, banker, or tie). This player bet is also referred to as the standard player bet/wager and this banker bet is also referred to as the standard banker bet/wager. Because these bets are unchanged from the standard game of Baccarat. The cards are dealt face down, two cards to the player and two cards to the banker, all face up. Depending on the two initial hands, both the player and the banker may draw a third card or stand. The hand with the higher total wins.

If the player or the banker (or both) achieve a total of 8 or 9 on the initial deal (known as a 'natural'), no further cards are drawn and the game is evaluated based on both initial two card hands. If neither player has a natural, then the play proceeds as follows. If the player has an initial total of 0-5, the player draws a third card. If the player then has an initial total of 6 or 7, the player stands.

If the player stands, the banker uses only the banker's own hand and acts according to the same rule as the player (the banker draws a third card if the banker has 0-5 and stands if the banker has 6 or 7).

If the player drew a third card, then the banker acts according to Table III.

TABLE III

| Player Draw Card | Banker Action |
|---|---|
| 2-3 | banker draws if banker has 0-4, stands if banker has 5-7 |
| 4-5 | banker draws if banker has 0-5, stands if banker has 6-7 |

TABLE III-continued

| Player Draw Card | Banker Action |
|---|---|
| 6-7 | banker draws if banker has 0-6, stands if banker has 3-7 |
| 8 | banker draws if banker has 0-2 and stands if banker has 3-7 |
| A, 9, 10 or face card | banker draws if banker has 0-3 and stands if banker has 4-7 |

The player (player or banker) with the highest hand wins. The score of each hand is computed by taking the physical point total of each hand modulo 10, which means that after adding the value of the cards the tens digit is ignored. For example, a hand of 3 and 4 is 7. A hand of 8 and 6 is scored as 4 (14 modulo 10). The first digit is dropped because the total is higher than 9. A hand consisting of 4 and 6 is worth zero. The highest (best) score that can be achieved is 9 (formed using 4/5; face card/9; A/8, 7/2; etc.)

The player can also bet on a tie. If the player's point total equals the banker's point total then the tie bet wins, otherwise the tie bet loses.

The present general inventive concept relates to a bet that the player can bet that he gets a "bad beat" or has a good hand but still loses, or loses by only one point. For example, if the player has a total of 8 but the banker has a 9, the player has lost by one point. Losing by only one point may cause some players some anguish.

The player can be presented with two betting circles, one for the player side bet and one for the banker side bet. The player wins the player side bet if the house beats the player by one point. The player wins the house side bet if the player beats the house by one point. The standard player and banker bets are not affected by the player side bets and the banker side bets.

Table IV represents a paytable where the player bets on the player side bet. For example, if the player bets $1 on the player side bet, and the player gets a point total of 8 (using the baccarat scoring method described herein) and the banker gets a point total of 9 (using the baccarat scoring method described herein) ("9 over 8"), then the player wins a payout of 30:1 (or $30) on the player bad beat bet. In Table IV, first column, the player total would be the lower total and the dealer total is the higher total (e.g., "9 over 8" means the dealer has 9 and the player has 8). When the player loses by one point this can be considered a "bad beat" (a term of art referring to when a party has a good hand but still loses). In a further embodiment, not all of the winning combinations in Table IV need be included as winning combinations (e.g., 2 over 1 can lose). Other payout structures can be used, and Table IV is merely one example of winning combinations and respective payouts. Thus, the player side bet wins if the player loses by one (which is the same as if the banker wins by one). Table IV represents eight decks.

TABLE IV

| Player Event | Pays | Combinations | Probability | Return |
|---|---|---|---|---|
| 9 over 8 | 30 | 55,279,842,324,480 | 0.011060 | 0.331785 |
| 8 over 7 | 20 | 79,056,148,815,872 | 0.015816 | 0.316326 |
| 7 over 6 | 6 | 100,883,873,370,112 | 0.020183 | 0.121099 |
| 6 over 5 | 3 | 46,435,736,207,360 | 0.009290 | 0.027870 |
| 5 over 4 | 3 | 41,782,247,059,456 | 0.008359 | 0.025077 |
| 4 over 3 | 3 | 38,147,840,425,984 | 0.007632 | 0.022896 |
| 3 over 2 | 3 | 22,766,694,555,648 | 0.004555 | 0.013664 |
| 2 over 1 | 3 | 20,469,715,722,240 | 0.004095 | 0.012286 |
| 1 over 0 | 3 | 24,291,119,898,624 | 0.004860 | 0.014579 |
| Loss | −1 | 4,569,285,057,123,580 | 0.914150 | −0.914150 |
| Total | | 4,998,398,275,503,360 | 1 | −0.028566 |

Table V below represents a paytable for a banker side bet. For example, if the player bets on the banker side bet and the banker has a total of 5 (using the baccarat scoring described above) and the player has a point total of 6 (using the baccarat scoring described above) then the player wins a 3:1 ("6 over 5" in Table V) payout on the player's banker side bet. In Table V, first column, the banker total would be the lower total and the player total would be the higher total (e.g., "8 over 7" means that the banker has 7 and the player has 8). When the banker loses by one point this can be considered a "bad beat" (a term of art referring to when a party has a good hand but still loses). In a further embodiment, not all of the winning combinations in Table V need be included as winning combinations (e.g., 2 over 1 can lose). Other payout structures can be used, and Table V is merely one example of winning combinations and respective payouts. Thus, the banker side bet would win if the banker loses by one (which is the same as if the player wins by one). Table V represents eight decks.

TABLE V

| Banker Event | Pays | Combinations | Probability | Return |
|---|---|---|---|---|
| 9 over 8 | 30 | 55,165,968,408,576 | 0.011037 | 0.331102 |
| 8 over 7 | 20 | 77,910,445,719,552 | 0.015587 | 0.311742 |
| 7 over 6 | 6 | 94,910,008,393,728 | 0.018988 | 0.113929 |
| 6 over 5 | 3 | 56,928,963,244,032 | 0.011389 | 0.034168 |
| 5 over 4 | 3 | 34,322,188,435,456 | 0.006867 | 0.020600 |
| 4 over 3 | 3 | 20,521,555,795,968 | 0.004106 | 0.012317 |
| 3 over 2 | 3 | 19,563,259,723,776 | 0.003914 | 0.011742 |
| 2 over 1 | 3 | 20,114,458,411,008 | 0.004024 | 0.012073 |
| 1 over 0 | 3 | 24,639,193,538,560 | 0.004929 | 0.014788 |
| Loss | −1 | 4,594,322,233,832,700 | 0.919159 | −0.919159 |
| Total | | 4,998,398,275,503,360 | 1 | −0.056699 |

Thus, if the player bets on the player side bet and the player hand loses by a point the player wins the player side bet, otherwise the player side bet loses. If the player bets on the banker side bet and the banker loses by one point then the player wins the banker side bet, otherwise the banker side bet loses. The payouts in Tables IV and Table V are equal, although they are not required to be and in other embodiments the payouts need not be identical for the player side bet and the banker side bet. The column entitled "combinations" column is the number of actual combinations possible based on eight decks. The "probability" column represents the probability that the respective situation will occur. The "return" column represents the actual contribution of that situation to the overall return of the respective side bet. The "total" row represents the total number of combinations for eight decks, the total contribution to the overall return (1) and the house advantage of the bet. For example, the player side bet has a house advantage (edge) of 2.86% while the banker side bet has a house advantage (edge) of 5.67%.

The paytables shown in Tables IV and V are merely exemplary, and of course other payouts can be used as well. In addition, other point differences can be used as well (for example differences of two points instead of one point). Subsets of the combinations in Tables IV and V can be used as well (in other words in another embodiment some of the winning combinations can be removed from the winning combinations). For example, 7 over 6 can pay 5 to 1.

Table VI below represents player bad beat bet with six decks.

TABLE VI

| Event | Pays | Combinations | Probability | Return |
|---|---|---|---|---|
| 9 over 8 | 30 | 9,722,219,136,768 | 0.011062 | 0.331866 |
| 8 over 7 | 20 | 13,904,546,379,264 | 0.015821 | 0.316419 |
| 7 over 6 | 6 | 17,742,879,436,032 | 0.020188 | 0.121130 |
| 6 over 5 | 3 | 8,166,265,159,680 | 0.009292 | 0.027875 |
| 5 over 4 | 3 | 7,349,105,228,544 | 0.008362 | 0.025086 |
| 4 over 3 | 3 | 6,707,806,239,744 | 0.007632 | 0.022897 |
| 3 over 2 | 3 | 4,003,057,580,544 | 0.004555 | 0.013664 |
| 2 over 1 | 3 | 3,597,643,123,200 | 0.004093 | 0.012280 |
| 1 over 0 | 3 | 4,264,128,824,832 | 0.004852 | 0.014556 |
| Loss | −1 | 803,411,555,787,072 | 0.914142 | −0.914142 |
| Total | | 878,869,206,895,680 | 1 | −0.028369 |

Table VII below represents a banker bad beat bet with six decks.

TABLE VII

| Event | Pays | Combinations | Probability | Return |
|---|---|---|---|---|
| 9 over 8 | 30 | 9,702,310,749,696 | 0.011040 | 0.331186 |
| 8 over 7 | 20 | 13,701,980,934,144 | 0.015590 | 0.311809 |
| 7 over 6 | 6 | 16,693,958,292,480 | 0.018995 | 0.113969 |
| 6 over 5 | 3 | 10,011,610,420,992 | 0.011391 | 0.034174 |
| 5 over 4 | 3 | 6,035,218,615,296 | 0.006867 | 0.020601 |
| 4 over 3 | 3 | 3,607,779,764,736 | 0.004105 | 0.012315 |
| 3 over 2 | 3 | 3,438,467,933,184 | 0.003912 | 0.011737 |
| 2 over 1 | 3 | 3,536,672,302,080 | 0.004024 | 0.012072 |
| 1 over 0 | 3 | 4,324,372,222,464 | 0.004920 | 0.014761 |
| Loss | −1 | 807,816,835,660,608 | 0.919155 | −0.919155 |
| Total | | 878,869,206,895,680 | 1 | −0.056529 |

If the 7 over 6 pays 5 to 1 instead of 6 to 1, then the house edge is as follows: Player Bad Beat with 8 decks: 4.87%; Banker Bad Beat with 8 decks: 7.57%; Player Bad Beat with 6 decks: 4.86%; Banker Bad Beat with 6 decks: 7.55%.

FIG. 1 is a flowchart illustrating a game of a Baccarat, according to an embodiment.

The method begins with operation 100, wherein the casino (house) receives wagers from players on the table. This is done as known in the art, wherein the player places wagers in respective betting circles on the table. The player can place any combination of wagers the player wishes using the betting circles as illustrated in FIG. 3B.

From operation 100, the method proceeds to operation 102, which deals and resolves the players hand and the banker's hand. This is done as described above and also as described in U.S. pre-grant publication 2008/0032760, which is incorporated by reference in its entirety.

From operation 102, the method proceeds to operation 104, which evaluates the point totals. This is done as described herein. The numerical values of each card in each hand (player's hand, banker's hand) are added together modulo 10 (which means dropping the first digit if the total is greater than 9). The numerical values of the cards are given their standard values with aces counting as one, 2-10's count as their face value, and face cards count as 0.

From operation 104, the method proceeds to operation 106, which resolves the wagers placed in operation 100. If the player bet on the tie bet and the player's total equals the banker's total, then the tie bet wins (can be paid at 8:1), otherwise the tie bet loses. If the player bet on the player bet: if the player's total is higher than the banker's total then the player bet wins; if the player's total ties the banker's total then the player bet pushes (neither wins or loses); if the player's total is less than the banker's total then the player bet loses. If the player bet on the banker bet: if the banker's total is higher than the player's total then the banker bet wins; if the banker's total ties the player's total then the banker bet pushes (neither wins or loses); if the banker's total is less than the player's total then the banker bet loses.

If the player also places the player side bet or the banker side bet, these bets can be resolved as described herein.

Figure 2A:
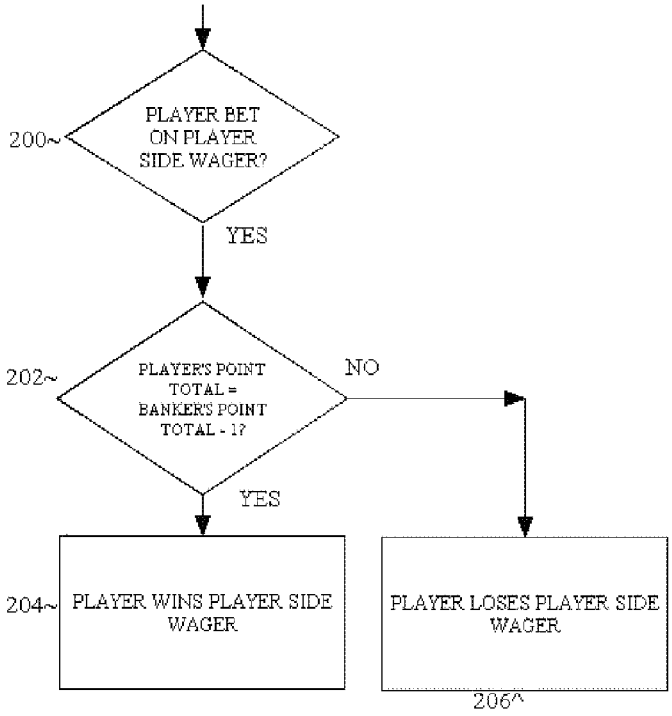
FIG. 2A is a flowchart illustrating a resolution of a player side wager, according to an embodiment.

FIG. 2A is a flowchart illustrating a resolution of a player side wager, according to an embodiment.

If in operation 200 it is determined that the player did not place the player side wager bet (in operation 100), then there is no need to proceed with FIG. 2A.

If in operation 200, it is determined that the player did place the player side wager bet (in operation 100), then the method proceeds to operation 202.

In operation 202, it is determined if the player's point total equals the banker's point total minus 1 (the banker wins by one point). If so, then the method proceeds to operation 204, wherein the player wins the player side wager and the payout is determined using a player side wager paytable.

If in operation 202, it is determined that the player's point total does not equal the banker's point total minus 1, then the method proceeds to operation 206 wherein the player loses the player side wager.

Figure 2B:
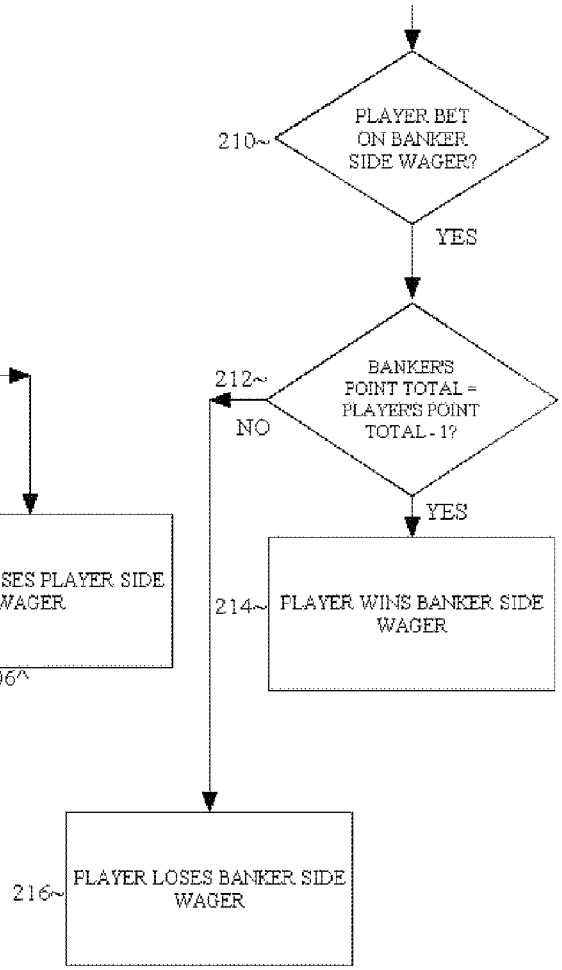
FIG. 2B is a flowchart illustrating resolution of a banker side wager, according to an embodiment.

FIG. 2B is a flowchart illustrating resolution of a banker side wager, according to an embodiment.

If in operation 210 it is determined that the player did not place the banker side wager bet (in operation 100), then there is no need to proceed with FIG. 2B.

If in operation 210, it is determined that the player did place the banker side wager bet (in operation 100), then the method proceeds to operation 212.

In operation 212, it is determined if the banker's point total equals the player's point total minus 1 (the player wins by one point). If so, then the method proceeds to operation 214, wherein the player wins the banker side wager and the payout is determined using a banker side wager paytable.

If in operation 212, it is determined that the banker's point total does not equal the player's point total minus 1, then the method proceeds to operation 216 wherein the player loses the banker side wager.

Figure 3A:
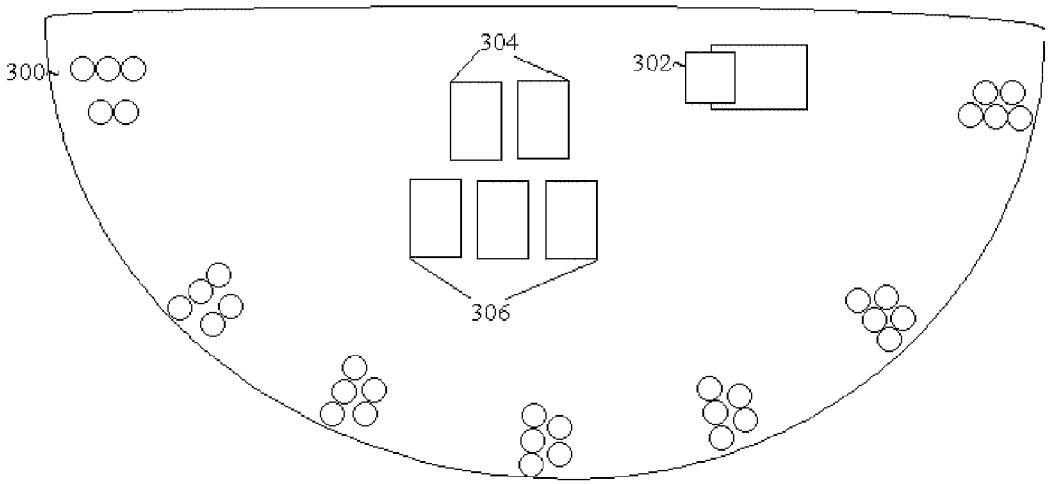
FIG. 3A is a drawing of a gaming table, according to an embodiment.
Figure 3B:
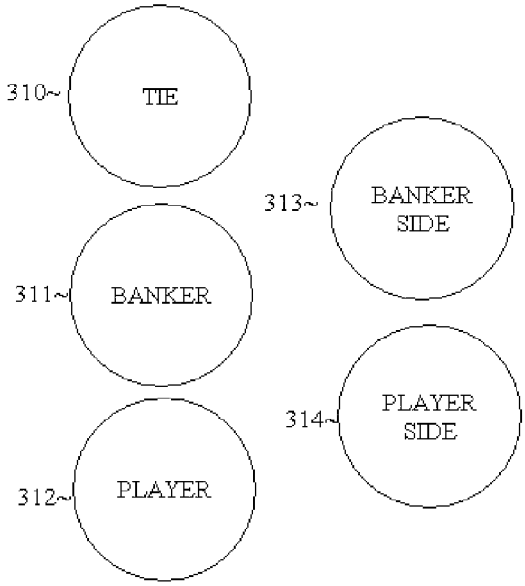
FIG. 3B is a drawing of betting circles that can be used to implement the methods described herein, according to an embodiment.

FIG. 3A is a drawing of a gaming table, according to an embodiment.

A physical gaming table 300 is used to play the game. An electronic card shuffler 302 can be used to shuffle the deck before each hand. A player's hand 306 and a banker's hand 304 are shown. The gaming table 300 illustrated can accommodate seven simultaneous players, although of course any other number of players can be accommodated as well. Each player has their own set of betting circles as illustrated in FIG. 3B.

Note that there is only one banker hand and one player hand dealt, and all players at the table share these common hands for their own respective wagers. There are no actions taken by the player other than choosing which bets to place before the game begins. Once bets are placed, the dealer resolves the game automatically and takes or pays the losing/winning wagers.

FIG. 3B is a drawing of betting circles that can be used to implement the methods described herein, according to an embodiment.

A tie betting circle 310 is used by the player to place the tie wager. A banker betting circle 311 is used by the player to place the standard baccarat banker wager. A player betting circle 312 is used by the player to place the standard baccarat player wager. A banker side wager betting circle 313 is used to place the banker side wager (also can be referred to as banker side bet) as described herein. A player side wager betting circle 314 is used to place the player side wager (also can be referred to as player side bet) as described herein.

The player can choose to bet on any combination of the five betting circles, and the player can even bet on both the player side bet and the banker side bet if the player wishes. The player is not required to bet on either of the side bets if the player does not want to.

Of course the layout of the betting areas illustrated in FIG. 3B can be arranged in any other manner, and the layout illustrated in FIG. 3B is merely one example.

Some examples of the game will now be presented. Joe bets $1 on the standard player bet and $1 on the player side bet. The dealer deals the player hand of 4/4 and the banker hand of 5/4. According to the baccarat rules, the banker and player do not draw. The player has a point total of 8 and the banker has a point total of 9. Thus, the player's point total is equal to the banker's point total minus one, thus the player side bet wins. According to Table II, this pays 30:1. Since the banker point total is higher than the player's point total, Joe loses the standard player bet. Thus, Joe loses the $1 on the standard player bet but won $30 on the player side bet. Thus, there are now $31 in chips on the table (the $30 payout on the player side bet plus the original side bet), which Joe can keep.

In the example above, if the cards dealt were the same but Joe bet $1 on the standard banker bet and $1 on the banker side bet, then Joe would have won the standard banker bet (since the banker has the higher point total) but would have lost the banker side bet (since the banker point total is not equal to the player point total minus 1). Thus, Joe would won a payout (typically even money) on the standard banker bet ($1) but lose the banker side bet, thus Joe would have $2 in chips on the table he can now take (breaks even).

As a further example, Jane places a $2 bet on the standard banker bet and $1 bet on the player side bet. The dealer deals the player a 2 and a 3 and the banker a 5 and a 2. According to baccarat rules, the player takes a third card which turns out to be an 8 for a point total of 3. According to Table II, the banker stands. Thus, the player has a point total of 3 vs. a banker's point total of 7. Jane loses the player side bet (since the player's point total is not equal to the dealer's point total minus 1), but Jane wins her standard banker bet because the banker's point total is higher than the player's point total. Thus Jane keeps her original $2 and wins $2 minus a 5% commission ($0.10) or $1.90. Thus, Jane has $3.90 on the table Jane can now keep.

As a final example, Bob places a $5 bet on the standard player bet, a $1 bet on the player side wager, and a $1 bet on the banker side wager. The dealers deals the player a 5 and a 10 and the dealer a 9 and a 2. According to Baccarat rules, the player hits (takes a card) and is dealt a 2, for a point total of 7. According to Baccarat rules, the dealer hits and receives a 5, for a banker point total of 6. Since the player point total is higher than the banker point total, Bob wins the standard player bet at 1:1 ($5). Because the player point total is one higher than the banker point total, the player wins the banker side bet wager and according to Table IV the player wins a payout of 6:1 or $6. Regarding the player side wager, since the banker point total is not one higher than the player point total, Bob loses the player side wager. Thus, Bob has originally wagered $7, lost the $1 player side wager, won $5 on the standard player bet, and won $6 on the banker side bet, for a net win of $10 with $17 in chips on the table Bob can take.

Figure 4:
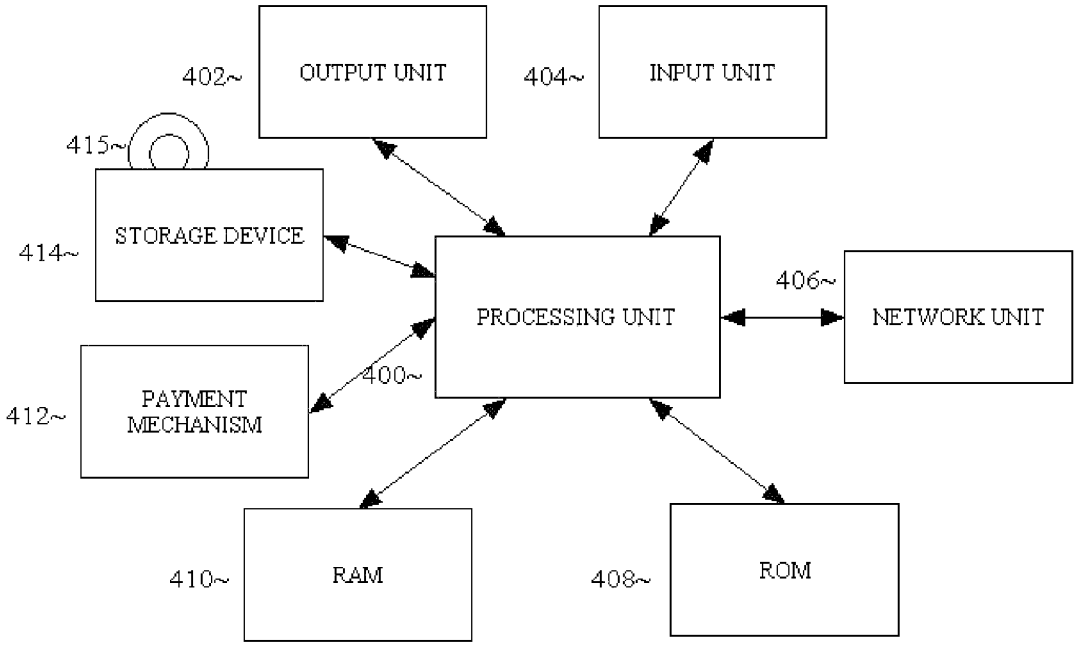
FIG. 4 is a block diagram of an electronic gaming apparatus that can be used to implement the methods described herein, according to an embodiment.

FIG. 4 is a block diagram of an electronic gaming apparatus that can be used to implement the methods described herein, according to an embodiment. The methods described herein can be played on a electronic gaming device, on a home computer, on a home computer running an Internet casino, on a multi-game unit at a casino or bar, on a portable computing device (e.g., tablet computer or cell phone), etc.

A processing unit 400 can be a microprocessor and associated structure (e.g., bus, cache, etc.) which can be connected to an output unit 402 (such as an LCD, touch-screen, etc.) and an input unit 404 (keyboard, touch-screen, buttons, mouse, etc.) The processing unit reads instructions from an electronic storage and executes the instructions which would be programmed to perform the methods described herein. The processing unit 400 can also be connected to a network unit 406 which can access a computer communications network (such as the Internet, a wifi, LAN, WAN, casino network, etc.) The processing unit 400 can also be connected to a ROM 408, a RAM 410, and a storage device 414 (such as a hard disc drive, CD-ROM drive, BLU-RAY drive, EPROM, etc.) which can read a computer readable storage medium 415 (such as a hard disc, CD, BLU-RAY disc, floppy disc, etc.) The computer readable storage medium 415 can store programs and assets to instruct the processing unit to execute any of the methods described herein. The processing unit 400 can also be connected to a payment mechanism 412. The payment mechanism 412 can be one or more units to accept or distribute payment, such as a: ticket/bill reader, a ticket printer, a electronic funds unit (to accept or distribute funds electronically to a player's bank or other electronic account), etc.

Any description of a component or embodiment herein also includes hardware, software, and configurations which already exist in the prior art and may be necessary to the operation of such component(s) or embodiment(s). As used herein, "player's total", "player's point total", and "player's score" are used interchangeably and mean the same thing. "banker's total", "banker's point total", and "banker's score" are used interchangeably and mean the same thing. The use of the word "dealer" can also be used to represent the "banker" except when referring to the actual human dealer dealing the cards at the table.

The physical game is played using physical cards and physical chips on a physical gaming table. Chips can be used which are immediately redeemable for cash at the casino cashier. An electronic mechanical shuffler can be used to shuffle the cards.

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for implementing a casino wagering game, the method comprising:

executing on an electronic processor computer readable instructions that direct the processor to perform:

providing betting areas for a standard player bet, a standard banker bet, a player side wager, and a dealer side wager;

providing a predetermined rule for resolving the player side wager which provides that the player side wager wins if a banker point total is one higher than a player point total for at least some player point totals;

providing a predetermined rule for resolving a banker side wager which provides that the banker side wager wins if the player point total is one higher than the banker point total for at least some banker point totals;

offering a player to an option to place any combination of a standard player bet, a standard banker bet, the player side wager, and the dealer side wager;

dealing a player's hand and a banker's hand;

resolving the player's hand and the banker's hand according to predetermined baccarat rules;

resolving the player side wager, if placed, according to the predetermined rule for resolving the player side wager; and resolving the dealer side wager, if placed, according to the predetermined rule for resolving the dealer side wager.

2. The method as recited in claim 1, wherein the predetermined rule for resolving the player side wager applies for player point totals from 0-8.

3. The method as recited in claim 2, wherein the predetermined rule for resolving the banker side wager applies for banker point totals from 0-8.

4. The method as recited in claim 1, wherein the predetermined rule for resolving the banker side wager applies for banker point totals from 0-8.

5. A method for implementing a casino wagering game, the method comprising:

executing on an electronic processor computer readable instructions that direct the processor to perform:

providing betting areas for a standard player bet, a standard banker bet, a player side wager, and a dealer side wager, wherein the dealer side wager wins when the player point total is one higher than the banker point total for at least some banker point totals;

receiving a player's side wager;

dealing a player's hand and a banker's hand;

resolving the player's hand and the banker's hand according to predetermined baccarat rules;

determining that a player's point total is one lower than a banker's point total, and paying a payout to the player on the payer's side wager.

6. The method as recited in claim 5, wherein the player side wager only wins for player point totals from 0-8.

7. The method as recited in claim 6, wherein the dealer side wager only wins for dealer point totals from 0-8.

8. The method as recited in claim 5, wherein the dealer side wager only wins for dealer point totals from 0-8.

9. An apparatus to implement a casino wagering game, the apparatus comprising:

an electronic processor configured to execute instructions that:

display betting areas for a standard player bet, a standard banker bet, a player side wager, and a dealer side wager;

provide a predetermined rule for resolving the player side wager which provides that the player side wager wins if a banker point total is one higher than a player point total for at least some player point totals;

provide a predetermined rule for resolving a banker side wager which provides that the banker side wager wins if the player point total is one higher than the banker point total for at least some banker point totals;

enable a player to an option to place any combination of a standard player bet, a standard banker bet, the player side wager, and the dealer side wager;

deal a player's hand and a banker's hand;

resolve the player's hand and the banker's hand according to predetermined baccarat rules;

resolve the player side wager, if placed, according to the predetermined rule for resolving the player side wager; and resolve the dealer side wager, if placed, according to the predetermined rule for resolving the dealer side wager.

10. The apparatus as recited in claim 9, wherein the processor is further configured such that the predetermined rule for resolving the player side wager applies for player point totals from 0-8.

11. The apparatus as recited in claim 10, wherein the processor is further configured such that the predetermined rule for resolving the banker side wager applies for banker point totals from 0-8.

12. The apparatus as recited in claim 9, wherein the processor is further configured such that the predetermined rule for resolving the banker side wager applies for banker point totals from 0-8.

* * * * *